US005547010A

United States Patent [19]

Stuart

[11] Patent Number: 5,547,010

[45] Date of Patent: Aug. 20, 1996

[54] ADJUSTABLE CURTAIN FRAME

[76] Inventor: Leigh S. Stuart, 55 Delmont Dr., Apt. A-2, Atlanta, Ga. 30305

[21] Appl. No.: 304,113

[22] Filed: Sep. 12, 1994

[51] Int. Cl.[6] ..... A47H 1/00

[52] U.S. Cl. ..... 160/335; 160/374

[58] Field of Search ..... 160/335, 333, 160/336, 374, 372, 368.1, 369; 5/627

[56] References Cited

U.S. PATENT DOCUMENTS

| | | | |
|---|---|---|---|
| 438,544 | 10/1890 | Henderson | 160/374 |
| 794,469 | 7/1905 | Sherwood | 160/376 X |
| 1,240,581 | 9/1917 | Kirsch | 160/374 |
| 1,336,101 | 4/1920 | Simone . | |
| 2,182,396 | 12/1939 | Copp | 156/10 |
| 3,055,419 | 9/1962 | Rubin et al. | 160/84 |
| 3,661,195 | 5/1972 | Fischer | 160/373 |
| 4,465,262 | 8/1984 | Itri et al. | 160/374 X |
| 4,825,611 | 5/1989 | Bassett | 160/372 X |
| 4,917,167 | 4/1990 | Voss et al. | 160/84.1 |
| 4,991,638 | 2/1991 | Magee et al. | 160/31 |
| 5,195,569 | 3/1993 | Peterson et al. | 160/84.1 |

*Primary Examiner*—Blair Johnson
*Attorney, Agent, or Firm*—Kennedy & Kennedy

[57] ABSTRACT

A curtain frame (10) adapted to be mounted in windows of various sizes has a peripheral frame (11), a telescopic upper curtain rod (12), a telescopic lower curtain rod (13) and a pair of hinges (15). The peripheral frame has four L-shaped corner members (17), a pair of upright members (20) telescopically mounted to the corner members and a pair of cross members (21) telescopically mounted to the corner members. A curtain (14) is mounted at one to the upper curtain rod and releasably mounted at its opposite end to the lower curtain rod. The vertical members and the cross members are slidably adjusted within the corner members to fit a window of a selected size with the curtain rods being self adjusted in length without altering its spacing from the upper cross member. The hinges allow the peripheral frame to be moved between a closed position covering the window and an open position opened uncovering the window.

14 Claims, 3 Drawing Sheets

ADJUSTABLE CURTAIN FRAME

TECHNICAL FIELD

This invention relates to curtain frames, and particularly to adjustable curtain frames adapted to be mounted in windows of various sizes.

BACKGROUND OF THE INVENTION

The interior of windows are often provided with window coverings such as curtains, shutters or shades for personal privacy and for blocking light passing through the windows. Window curtains are typically suspended from elongated rods mounted to the wall above the windows. These curtains are typically custom sized and shaped to fit a particular window. Therefore, it is usually not practical to re-use the curtain on another window of a different size.

Similarly, shutters and shades are typically custom manufactured to conform closely to the inner dimensions of a window frame to which they are mounted, as shown in U.S. Pat. Nos. 5,195,569, 4,917,167, and 3,661,195. Again, as these products are of a selected width and height they too cannot be easily transferred and properly fitted to another window of a different width or height. Some window shades have been designed to adjust horizontally to the size of a window opening, as shown in U.S. Pat. No. 1,336,101. However, these types of window shades are not also adjustable in height. Furthermore, these window shades are designed to be mounted either within the window opening or totally removed from the opening, hence they cannot quickly and easily be moved back and forth between an open and closed configuration.

It thus is seen that a need remains for a window covering which may be adapted to fit windows of various sizes. Accordingly, it is to the provision of such that the present invention is primarily directed.

SUMMARY OF THE INVENTION

In a preferred form of the invention, an adjustable curtain frame is provided which is adapted to be mounted in windows of various sizes. The adjustable curtain frame comprises four tubular, L-shaped corner members each having a horizontal portion and a vertical portion, two upright members each having opposite ends telescopically mounted to the vertical portions of the corner members, and two cross members having opposite ends telescopically mounted to the horizontal portions of the corner members. A telescoping curtain rod is mounted to two of the corner members substantially parallel with and below the cross member. With this construction, as the vertical members and cross members are adjusted in the corner members to fit a window of a selected size, the curtain rod is self adjusted in length to coincide with the movement of the cross members without altering its spacing from the upper cross member.

DETAILED DESCRIPTION

Figure 1:
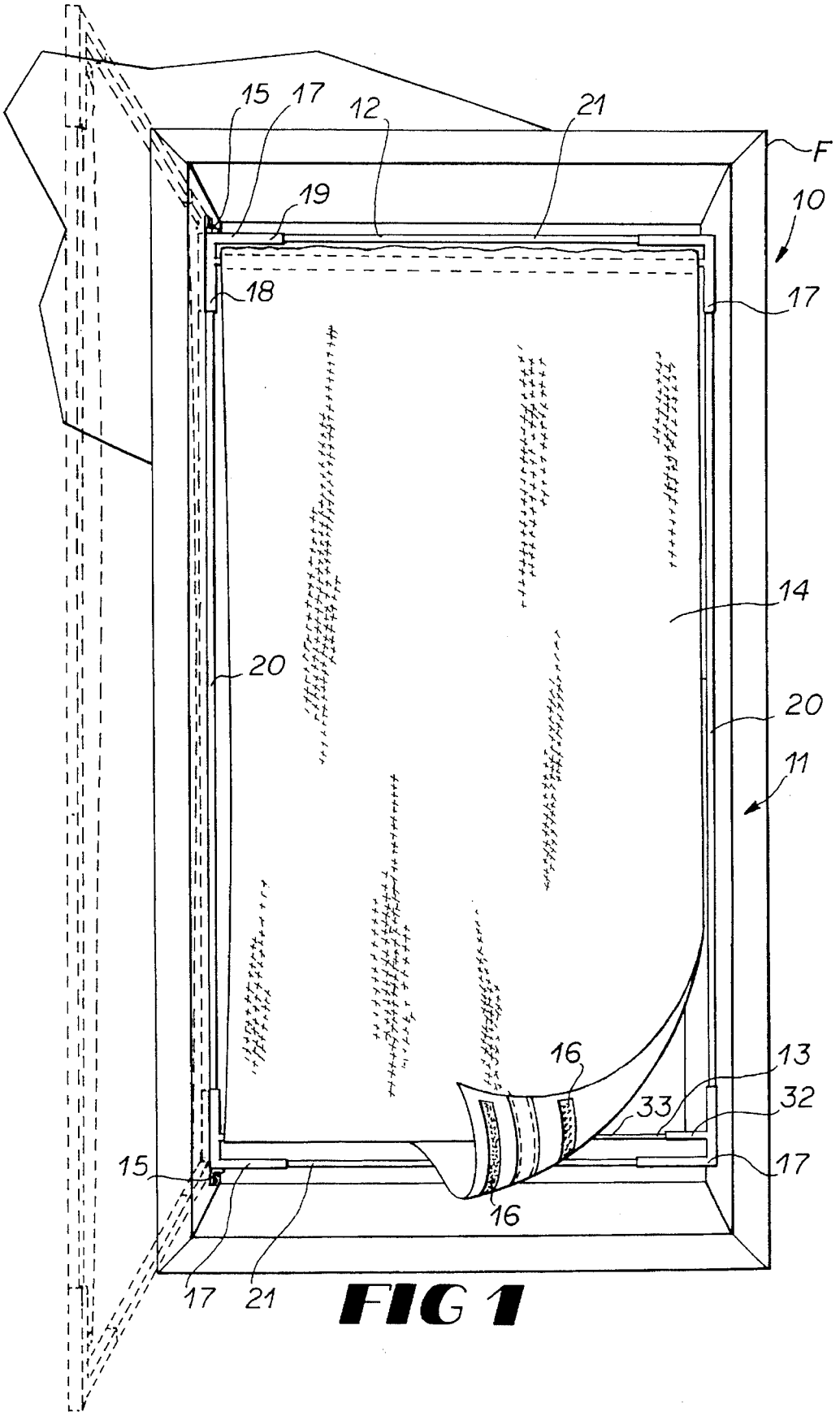
FIG. 1 is a front view of an adjustable curtain frame made in accordance with principles of the invention in a preferred form shown mounted to a window frame and with a curtain mounted thereon.
Figure 2:
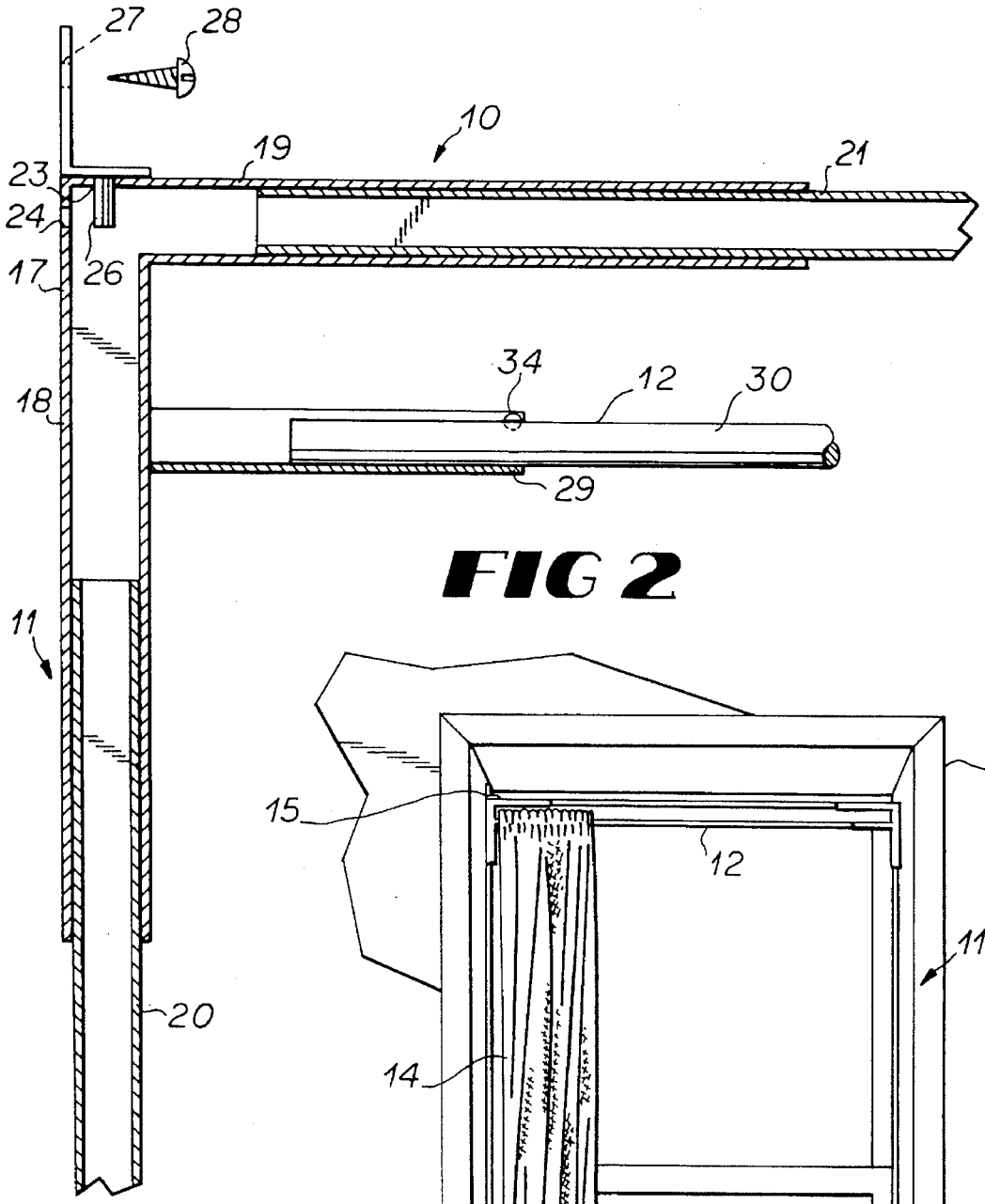
FIG. 2 is a cross sectional view of a corner portion of the curtain frame of FIG. 1.

With reference next to the drawing, there is shown an adjustable curtain frame 10 having a peripheral frame 11, an upper curtain rod 12 mounted to an upper portion of the peripheral frame 11, a lower curtain rod 13 mounted to a lower portion of the peripheral frame, and a pair of L-shaped hinges 15 mounted to the peripheral frame. A fabric curtain 14 is mounted at one end to the upper curtain rod 12 and releasably mounted at its opposite end to the lower curtain rod 13. The curtain 14 has two mating hook and loop type fastener strips 16 which enable the curtain to be folded over the lower curtain rod and releasably fastened to itself.

The peripheral frame 11 has four tubular L-shaped corner members 17 each having a vertical portion 18 and a horizontal portion 19. The peripheral frame also has two substantially parallel upright members 20 telescopically mounted to the vertical portion 18 of the corner members 17 and two substantially parallel cross members 21 telescopically mounted to the horizontal portion 19 of the corner members. The corner members 17 have top hinge mounting holes 23 and side hinge mounting holes 24. The hinges 15 have mounting posts 26 sized to be received within mounting holes 23 and mounting holes 24, and mounting holes 27 sized to receive threaded mounting screws 28 for securing the hinges to a window frame F.

The upper curtain rod 12 is comprised of two U-shaped channel members 29 integrally extending from the vertical portion 18 of the upper corner members 17, and an elongated rod 30 telescopically mounted at its ends to channel members 29. Similarly, the lower curtain rod 13 has two inverted U-shaped channel members 32 integrally extending from the vertical portion 18 of the lower corner members 17, and an elongated rod 33 telescopically mounted at its ends to channel members 32. The elongated rods 30 and 33 are maintained within the channel members by detents 34.

In use, the curtain frame 10 is adjusted so as to fit within the interior dimensions of a window frame F. This is done by forcing the upright members 20 within the vertical portions 18 of the corner members 17 until the desired curtain frame height is achieved. Similarly, the cross members 21 are forced into the horizontal portions 19 of the corner members until the desired curtain frame width is achieved. The upright members and cross members are sized to be fitted tightly within the corner members to secure their positions therein. Unshown conventional set screws may also be used to ensure a secure positioning of the upright and cross members. The cross members and upright members may be forcibly extended from the corner members to increase the height and width of the peripheral frame.

Figure 6:
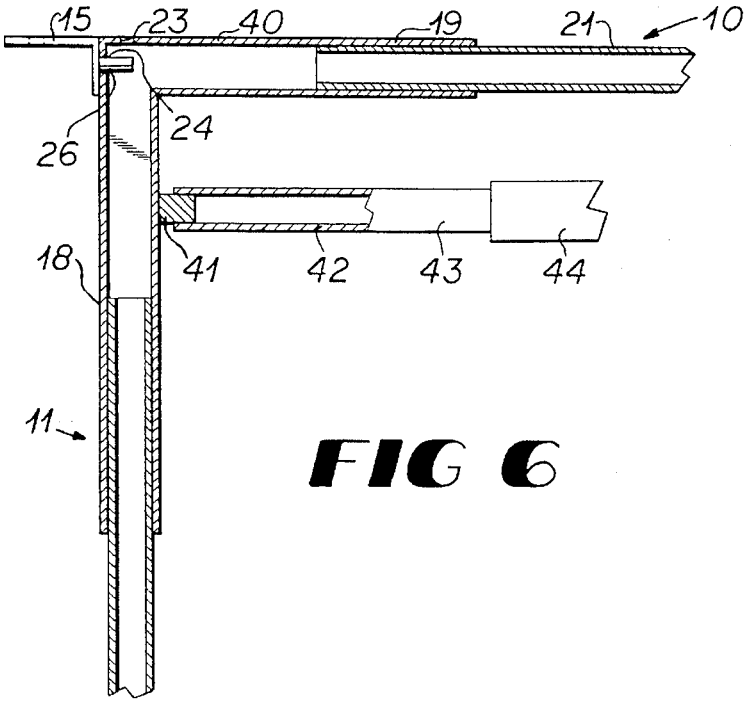
FIG. 6 is a cross sectional view of a corner portion embodying principles of the invention in another preferred form.

Should it be desired that the curtain frame 10 swing sideways to an open configuration, as shown in phantom lines in FIG. 1, the hinges 15 are mounted to the corner members with their hinge posts 26 positioned within the top mounting holes 23 of the corner members. Alternatively, the bottom of the curtain frame may swing upwards to an open position by positioning the hinge posts 26 through the side mounting holes 24 of the corner members, as shown in FIG. 6. The curtain frame 10 is mounted to the window frame F by threading screws 28 through hinge mounting holes 27 and into the window frame F.

Figure 3:
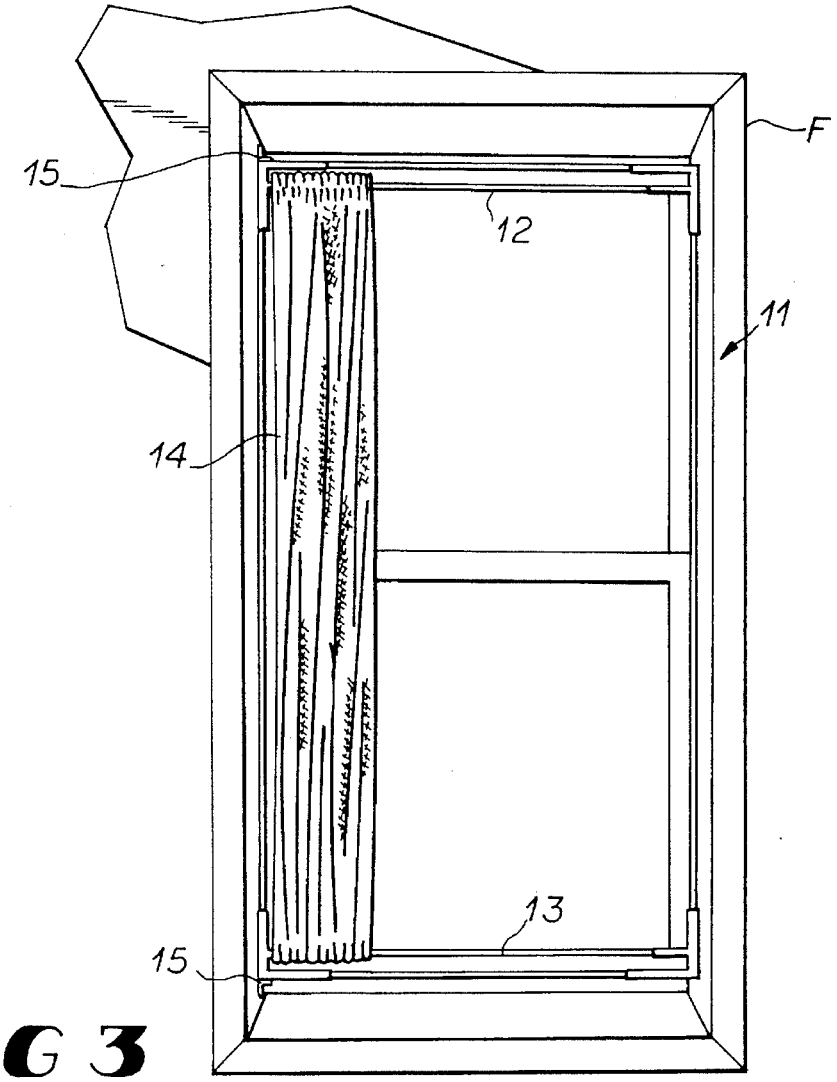
FIG. 3 is a front view of the adjustable curtain frame of FIG. 1 shown with the curtain drawn to one side.
Figure 4:
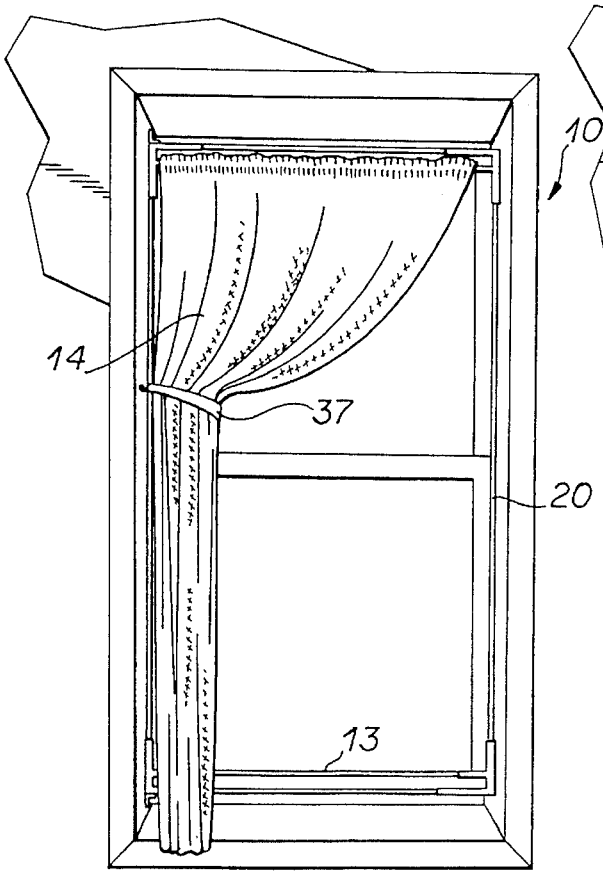
FIG. 4 is a front view of the adjustable curtain frame of FIG. 1 shown with the curtain drawn to one side and the bottom of the curtain released from the lower curtain rod.
Figure 5:
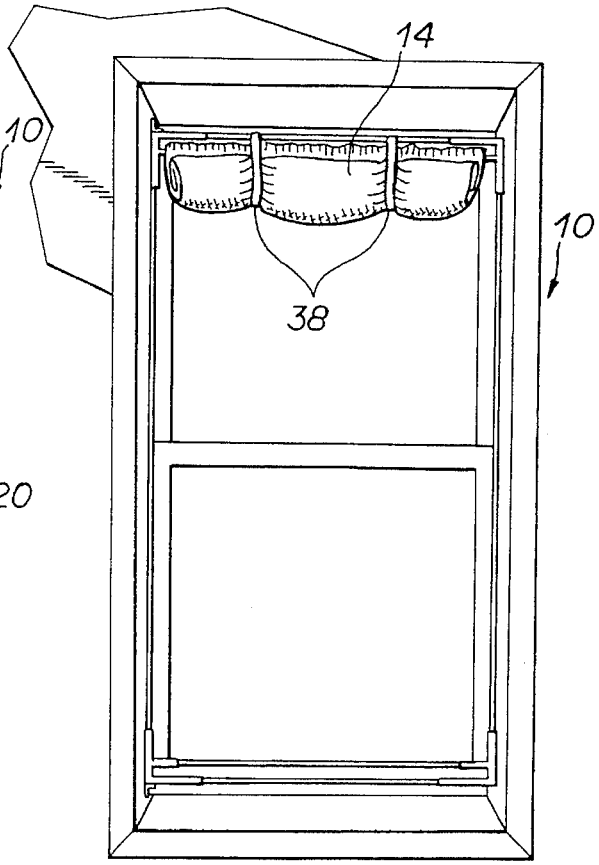
FIG. 5 is a front view of the adjustable curtain frame of FIG. 1 shown with the curtain rolled up and bound to the top of the curtain frame.

A curtain 14 is conventionally mounted to the elongated rod 30 of the upper curtain rod 12 which in turn is forced into the U-shaped channel members 29. Similarly, the elongated rod 33 of the lower curtain rod 13 is forced into the inverted U-shaped channel members 32 and the bottom portion of the curtain is wrapped about the lower curtain rod 13 and fastened to itself through fastener strips 16. The curtain may be arranged or positioned across the entire length of the curtain rods as shown in FIG. 1, or pushed to one side to expose the window as shown in FIG. 3. Alternatively, the curtain may be released from the lower curtain rod and secured to one side of an upright member with a strap 37 as shown in FIG. 4, or rolled and secured to the upper cross member with a pair of straps 38.

As shown in FIG. 6, an alternative form of the curtain frame 10 has corner members 40 having posts 41 extending therefrom and a telescopic curtain rod 42 is mounted at its ends to the posts 41. The curtain rod 42 has a first rod portion 43 telescopically mounted within a second rod portion 44. The first rod portion 43 is slidably moved within the second rod portion 44 to vary the length of the curtain rod as the width of the peripheral frame is varied by the movement of the cross members within the corner members.

It should be understood that although the peripheral frame 11 may be adjusted to various sizes the position of the upper curtain rod 12 remains the same with respect to the upper cross member 21 to maintain a constant spacing therebetween. Also, the curtain rods are capable of changing lengths to coincide with the changing width of the peripheral frame. In this manner, the curtain frame may be sized for a particular window and later re-sized to fit another window of a different size. Additionally, the adjustability of the curtain frame eliminates the need for producing custom made curtain frames for a specific window frame size.

From the foregoing it is seen that a curtain frame is now provided which may be adjusted to a selected window frame size and which may also be re-adjusted to another window frame of a different size. It should be understood, however, that many modification, additions and deletions may, in addition to those expressly recited, be made to the specific embodiments illustrated without departure from the spirit and scope of the invention as set forth in the following claims.

What is claimed is:

1. An adjustable curtain frame adapted to be mounted in windows of various sizes and with the adjustable curtain frame comprising a peripheral frame having four tubular, L-shaped corner members each having a horizontal portion and a vertical portion, two upright members each having opposite ends telescopically mounted to said vertical portions of said corner members, two cross members having opposite ends telescopically mounted to said horizontal portions of said corner members, and a telescoping curtain rod mounted to two of said corner members substantially parallel and adjacent one of said cross members; and hinge means for hingedly mounting said peripheral frame to a window, whereby as the vertical members and cross members are adjusted in the corner members to fit a window of a selected size the curtain rod is self adjusted in length without altering its spacing from the adjacent cross member.

2. The frame of claim 1 wherein said hinge means comprises a first hinge mounted to one said corner member and a second hinge mounted to another said corner member.

3. An adjustable curtain frame adapted to be mounted in windows of various sizes and with the adjustable curtain frame comprising four tubular, L-shaped corner members each having a horizontal portion and a vertical portion; two upright members each having opposite ends telescopically mounted to said vertical portions of said corner members; two cross members having opposite ends telescopically mounted to said horizontal portions of said corner members; a telescoping curtain rod mounted to two of said corner members substantially parallel and adjacent one of said cross members, and a curtain mounted to said curtain rod, whereby as the vertical members and cross members are adjusted in the corner members to fit a window of a selected size the curtain rod is self adjusted in length without altering its spacing from the adjacent cross member.

4. An adjustable curtain frame adapted to be mounted in windows of various sizes and with the adjustable curtain frame comprising four tubular, L-shaped corner members each having a horizontal portion and a vertical portion; two upright members each having opposite ends telescopically mounted to said vertical portions of said corner members; two cross members having opposite ends telescopically mounted to said horizontal portions of said corner members; a telescoping curtain rod mounted to two of said corner members substantially parallel and adjacent one of said cross members, another telescoping curtain rod mounted to two said corner members, and a curtain mounted at one end to said curtain road and releasably mounted at its opposite end to said other curtain rod, whereby as the vertical members and cross members are adjusted in the corner members to fit a window of a selected size the curtain rod is self adjusted in length without altering its spacing from the adjacent cross member.

5. An adjustable curtain frame adapted to be mounted to the a window frame, the adjustable curtain frame comprising, a generally rectangular, peripheral frame having four corner members; two upright members having opposite ends telescopically mounted to said corner members; two cross members having opposite ends telescopically mounted to said corner members; at least one curtain rod mounted to said peripheral frame; a curtain mounted to said curtain rod; and hinge means mounted to said peripheral frame for pivotal movement of said peripheral frame between a closed position closely adjacent the window frame and an open position distal the window frame, whereby the upright members may be extended and contracted to adjust the height of the window frame and the cross members may be extended and contracted to adjust the width of the window frame.

6. The frame of claim 5 further comprising another curtain rod and wherein said curtain is releasably mounted at one end to said other curtain rod.

7. The frame of claim 5 wherein said curtain rod includes adjustable means for changing the length of said curtain rod.

8. The frame of claim 5, wherein said curtain rod is mounted to two laterally opposed corner members.

9. The frame of claim 7 wherein said curtain rod comprises an elongated channel member extending from each said two laterally opposed corner members, said channel members being sized and shaped to telescopically mate with the ends of said elongated member.

10. The frame of claim 9 wherein said hinge means comprises two hinges each mounted to oppositely disposed said corner members.

11. The frame of claim 10 wherein said oppositely disposed corner members are vertically disposed.

12. An adjustable curtain frame adapted to be mounted in windows of various sizes and with the adjustable curtain frame comprising a generally rectangular peripheral frame having a first corner member defining a first frame corner, a second corner member oriented diagonally from said first corner member to define a second frame corner, a first upright member slidably mounted to said first corner member, a first cross member coupled to said first upright member to form a third frame corner and slidably mounted to said second corner member, a second upright member slidably mounted to said second corner member, and a second cross member coupled to said second upright member to form a fourth frame corner and slidably mounted to said first corner member; a curtain rod mounted to said peripheral frame generally parallel to said first cross member; and hinge means for hingedly mounting said peripheral frame to a window, whereby the vertical members and cross members are adjustable in the corner members to vary the size of the peripheral frame so as to fit a window of a selected size.

13. The frame of claim 12 wherein said curtain rod is a telescoping curtain rod.

14. The frame of claim 13 wherein said telescoping curtain rod is comprised of at least one tubular support member extending from one said corner member and an elongated member slidably mounted to said support member.

* * * * *